US008813857B2

(12) United States Patent
Mills et al.

(10) Patent No.: US 8,813,857 B2
(45) Date of Patent: Aug. 26, 2014

(54) ANNULUS MOUNTED POTENTIAL ENERGY DRIVEN SETTING TOOL

(75) Inventors: Aubrey C. Mills, Magnolia, TX (US); Basil J. Joseph, Sugar Land, TX (US); Ammar A. Munshi, Sugar Land, TX (US); Keven O'Connor, Houston, TX (US); Charles W. Pleasants, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 392 days.

(21) Appl. No.: 13/029,266

(22) Filed: Feb. 17, 2011

(65) Prior Publication Data

US 2012/0211221 A1 Aug. 23, 2012

(51) Int. Cl.
*E21B 33/129* (2006.01)
*E21B 23/06* (2006.01)
*E21B 23/04* (2006.01)

(52) U.S. Cl.
CPC ..... *E21B 23/04* (2013.01); *E21B 23/06* (2013.01)
USPC ..... 166/387; 166/66.6; 166/122; 166/187

(58) Field of Classification Search
USPC ..... 166/66.6, 122, 187, 387
See application file for complete search history.

(56) References Cited

U.S. PATENT DOCUMENTS 3,264,994 A 8/1966 Leutwyler
3,527,296 A * 9/1970 Malone ..... 166/122
3,754,597 A * 8/1973 Garrett ..... 166/72
4,776,396 A * 10/1988 Studholme ..... 166/187
5,086,853 A * 2/1992 Evans ..... 175/297
5,101,904 A 4/1992 Gilbert
5,188,183 A * 2/1993 Hopmann et al. ..... 166/387
5,447,702 A 9/1995 Campbell et al.
5,544,705 A * 8/1996 Jones et al. ..... 166/250.04
5,810,082 A 9/1998 Jordan, Jr.
6,173,786 B1 1/2001 Sampson et al.
6,354,374 B1 * 3/2002 Edwards et al. ..... 166/297
6,359,569 B2 3/2002 Beck et al.
6,364,037 B1 4/2002 Brunnert et al.
6,481,505 B2 11/2002 Beck et al.
6,497,280 B2 12/2002 Beck et al.
6,588,505 B2 7/2003 Beck et al.
6,624,759 B2 9/2003 Tubel et al.
6,851,481 B2 2/2005 Vinegar et al.
6,877,564 B2 * 4/2005 Layton et al. ..... 166/332.8

(Continued)

FOREIGN PATENT DOCUMENTS

WO 9315306 8/1993
WO 0177480 10/2001
WO 2004018833 3/2004
WO 2007036722 4/2007

*Primary Examiner* — Jennifer H Gay
(74) *Attorney, Agent, or Firm* — Steve Rosenblatt

(57) ABSTRACT

An actuator and method for setting a subterranean tool uses an externally mounted actuator on a tubular string that is operably engaged to the tool to be actuated. At the desired location for actuation a signal is given to a valve assembly. The opening of the valve releases the pressurized compressible fluid against a floating piston. The piston drives viscous fluid ahead of itself through the now open valve that in turn drives an actuating piston whose movement sets the tool. The triggering mechanism to open the valve can be a variety of methods including an acoustic signal, a vibration signal, a change in magnetic field, or elastic deformation of the tubular wall adjacent the valve assembly.

34 Claims, 2 Drawing Sheets

(56) References Cited

U.S. PATENT DOCUMENTS

| | | | | |
|---|---|---|---|---|
| 7,108,073 | B2 | 9/2006 | Patel | |
| 7,216,713 | B2 | 5/2007 | Read, Jr. | |
| 7,237,616 | B2 | 7/2007 | Patel | |
| 7,252,152 | B2 | 8/2007 | LoGiudice et al. | |
| 7,318,471 | B2 * | 1/2008 | Rodney et al. | 166/250.01 |
| 7,367,405 | B2 | 5/2008 | Murray | |
| 7,438,130 | B2 | 10/2008 | Read, Jr. | |
| 7,503,398 | B2 | 3/2009 | LoGiudice et al. | |
| 7,562,712 | B2 | 7/2009 | Cho et al. | |
| 7,591,319 | B2 | 9/2009 | Xu | |
| 7,604,062 | B2 | 10/2009 | Murray | |
| 7,665,527 | B2 * | 2/2010 | Loretz | 166/373 |
| 7,730,954 | B2 * | 6/2010 | Schultz et al. | 166/373 |
| 7,775,283 | B2 * | 8/2010 | Coronado et al. | 166/323 |
| 7,806,179 | B2 | 10/2010 | Coronado et al. | |
| 7,819,198 | B2 | 10/2010 | Birckhead et al. | |
| 7,836,956 | B2 | 11/2010 | Smithson et al. | |
| 7,866,406 | B2 * | 1/2011 | Mackenzie | 166/382 |
| 7,926,575 | B2 * | 4/2011 | Ringgenberg et al. | 166/375 |
| 7,971,651 | B2 | 7/2011 | Tanju et al. | |
| 8,162,066 | B2 * | 4/2012 | Farmer et al. | 166/375 |
| 2004/0060704 | A1 * | 4/2004 | Layton et al. | 166/332.8 |
| 2004/0226720 | A1 * | 11/2004 | Schultz et al. | 166/321 |
| 2005/0133220 | A1 * | 6/2005 | Bishop | 166/255.2 |
| 2005/0284625 | A1 * | 12/2005 | Rodney et al. | 166/250.01 |
| 2007/0089911 | A1 | 4/2007 | Moyes | |
| 2007/0289473 | A1 | 12/2007 | Bussear | |
| 2008/0023229 | A1 | 1/2008 | Richards et al. | |
| 2008/0149323 | A1 * | 6/2008 | O'Malley et al. | 166/53 |
| 2008/0149350 | A1 * | 6/2008 | Cochran et al. | 166/386 |
| 2009/0038802 | A1 | 2/2009 | Lucas | |
| 2009/0050373 | A1 * | 2/2009 | Loretz | 175/59 |
| 2009/0139722 | A1 | 6/2009 | Bussear et al. | |
| 2009/0139822 | A1 | 6/2009 | Yoo | |
| 2009/0229832 | A1 | 9/2009 | King | |
| 2010/0071912 | A1 * | 3/2010 | Mackenzie | 166/387 |
| 2010/0126711 | A1 * | 5/2010 | Buss et al. | 166/66.7 |
| 2010/0200245 | A1 * | 8/2010 | Ringgenberg et al. | 166/375 |
| 2010/0243269 | A1 | 9/2010 | Solhuag et al. | |
| 2011/0168403 | A1 | 7/2011 | Patel | |
| 2011/0284240 | A1 * | 11/2011 | Chen et al. | 166/373 |
| 2012/0211221 | A1 * | 8/2012 | Mills et al. | 166/180 |
| 2012/0211245 | A1 * | 8/2012 | Fuhst et al. | 166/382 |
| 2013/0014941 | A1 | 1/2013 | Tips et al. | |
| 2013/0020092 | A1 | 1/2013 | Ramon et al. | |

* cited by examiner

ANNULUS MOUNTED POTENTIAL ENERGY DRIVEN SETTING TOOL

FIELD OF THE INVENTION

The field of the invention is actuators and actuation methods for operating a subterranean tool and more particularly actuation of a tool disposed about a tubular without a wall opening in the tubular using potential energy in the actuator when running in.

BACKGROUND OF THE INVENTION

Many operations in a subterranean borehole involve the setting of tools that are mounted outside of a tubular string. A common example is a packer or slips that can be used to seal an annular space or/and support a tubular string from another. Mechanical actuation techniques for such devices, which used applied or hydrostatic pressure to actuate a piston to drive slips up cones and compress sealing elements into a sealing position, involved openings in the tubular wall. These openings are considered potential leak paths that reduce reliability and are not desirable.

Alternative techniques were developed that accomplished the task of tool actuation without wall openings. These devices used annular fluid that was selectively admitted into the actuator tool housing and as a result of such fluid entry a reaction ensued that created pressure in the actuator housing to operate the tool. In one version the admission of water into a portion of the actuator allowed a material to be reacted to create hydrogen gas which was then used to drive a piston to set a tool such as a packer. Some examples of such tools that operate with the gas generation principle are U.S. Pat. No. 7,591,319 and US Publications 2007/0089911 and 2009/0038802.

These devices that had to generate pressure downhole were complicated and expensive. In some instances the available space was restricted for such devices limiting their feasibility. What is needed and provided by the present invention is an actuator that goes in the hole with stored potential energy that employs a variety of signaling techniques from the surface to actuate the tool and release the setting pressure/force. The preferred potential energy source is compressed gas. Those skilled in the art will further understand the invention from a review of the description of the preferred embodiment and the associated drawings while further appreciating that the full scope of the invention is to be determined by the appended claims.

SUMMARY OF THE INVENTION

An actuator and method for setting a subterranean tool uses an externally mounted actuator on a tubular string that is operably engaged to the tool to be actuated. At the desired location for actuation a signal is given to a valve assembly. The opening of the valve releases the pressurized compressible fluid against a floating piston. The piston drives viscous fluid ahead of itself through the now open valve that in turn drives an actuating piston whose movement sets the tool. The triggering mechanism to open the valve can be a variety of methods including an acoustic signal, a vibration signal, a change in magnetic field, or elastic deformation of the tubular wall adjacent the valve assembly.

DETAILED DESCRIPTION OF THE PREFERRED EMBODIMENT

Figure 1:
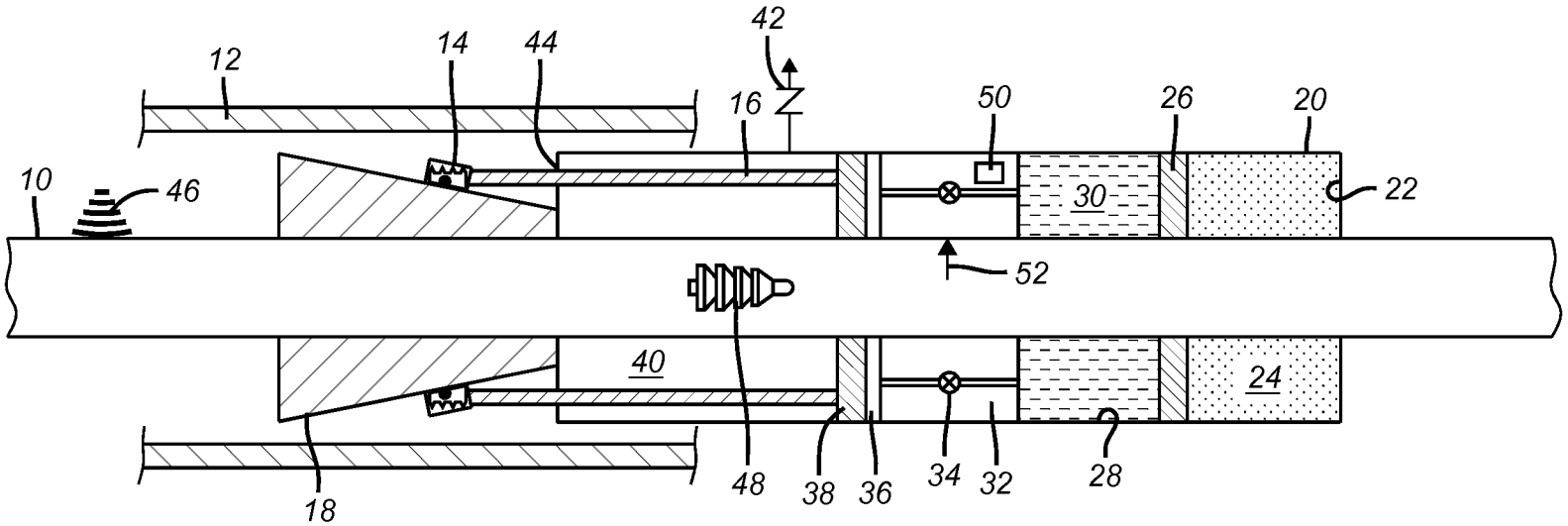
FIG. 1 is the assembly in the "run in the hole" position.

FIG. 1 illustrates a tubular string 10 run into a wellbore 12 that is preferably cased. The tool to be actuated 14 is illustrated schematically as a metal to metal and/or elastomer seal that can have slips for fixation to the outer wellbore tubular 12 when the actuation link 16 is caused to move axially. A cone 18 is used to urge the tool 14 radially into contact with the borehole or tubular 12. The link 16 extends from housing 20 that is attached to the tubular string 10. String 10 passes through the housing 20 to define an annular shape 22 that is charged at a predetermined pressure with a compressible fluid or an alternative source of potential energy 24. A floating piston 26 defines the annular volume 22 on one side and annular volume 28 on the opposite side. Annular volume 28 is filled with a viscous fluid such as light weight oil 30. Valve body 32 has a remotely actuated valve 34. In the closed position of valve 34 the oil 30 is contained in annular volume 28. Annular volume 36 is defined between valve body 32 and actuation piston 38. Movement of piston 38 moves the link 16 to actuate the tool 14 such as by moving it up the ramp 18. Pistons 26 and 38 have outer peripheral seals against the housing 20 and inner seals against the tubing string 10. Annular volume 40 can be enclosed with low or no pressure or depending on the installation depth it can be open to the annulus through a check valve 42 that lets fluid escape out of volume 40 as it gets smaller when the link 16 is moved. Link 16 is sealed at 44 to keep surrounding fluids out of volume 40 as the tool 14 is set with movement of the link 16.

Opening valve 34 can be performed by an acoustic signal 46 that is illustrated schematically. Alternatively the valve 34 can be actuated with a dart or a wireline delivering a triggering tool all schematically represented by the number 48 that passes close to valve 34 and has a field such as an electromagnetic or permanent magnet field that communicates with sensor 50 on the valve housing 32. Another method to operate valve 34 is to elastically deform the wall of the tubular in string 10 adjacent a sensor in the housing 32. A straddle tool having a pair of spaced seals to create an enclosed volume into which pressure is delivered to flex the wall of the tubular 10 as indicated by arrow 52 is envisioned. Alternatively, a wireline tool can be lowered to communicate with the valve housing 32 using magnetic, radio, ultrasonic, acoustic or mechanical signals all are schematically illustrated in number 46 as ways to set the tool 14. While the pistons 26 and 38 are shown as annular pistons they can also be rod pistons. Piston 26 can be eliminated so that the opening of valve 34 can employ the compressible fluid directly to move the piston 38 that is connected to the link or links 16. The movement of the piston 38 is preferably axial but it can be rotational or a combination of the two when properly guided in its movements for setting the tool 14. Although it is preferred to set the tool 14 as quickly as possible the rate at which it sets can be controlled with the size of the passage 54 that leads to and away from valve 34. While using light oil 30 is preferred other relatively low viscosity fluids down to water can be used. The use of the piston 26 allows compensation for thermally induced pressure buildup in the compressible fluid 24 triggered by the temperature of the surrounding well fluids. Apart from the various signals mentioned above for opening the valve 34, other triggers are possible although their use is less optimal than the techniques already discussed. The valve 34 can be triggered with time, temperature or proximity to devices carried by the string 10 that communicate in a variety of forms with the sensors and processor in the housing 32. While the preferred tool 14 is an annular barrier other tools can be actuated outside the tubular 10 while avoiding having openings through its walls. Some of those tools can be anchors or centralizers, for example. While compressed gas as the potential energy source 24 is preferred other options such as using a shape memory alloy or a bistable material or a mechanical spring such as a coiled spring or a Belleville washer stack to trigger piston 38 are other options and are schematically indicated also by the number 24.

Figure 2:
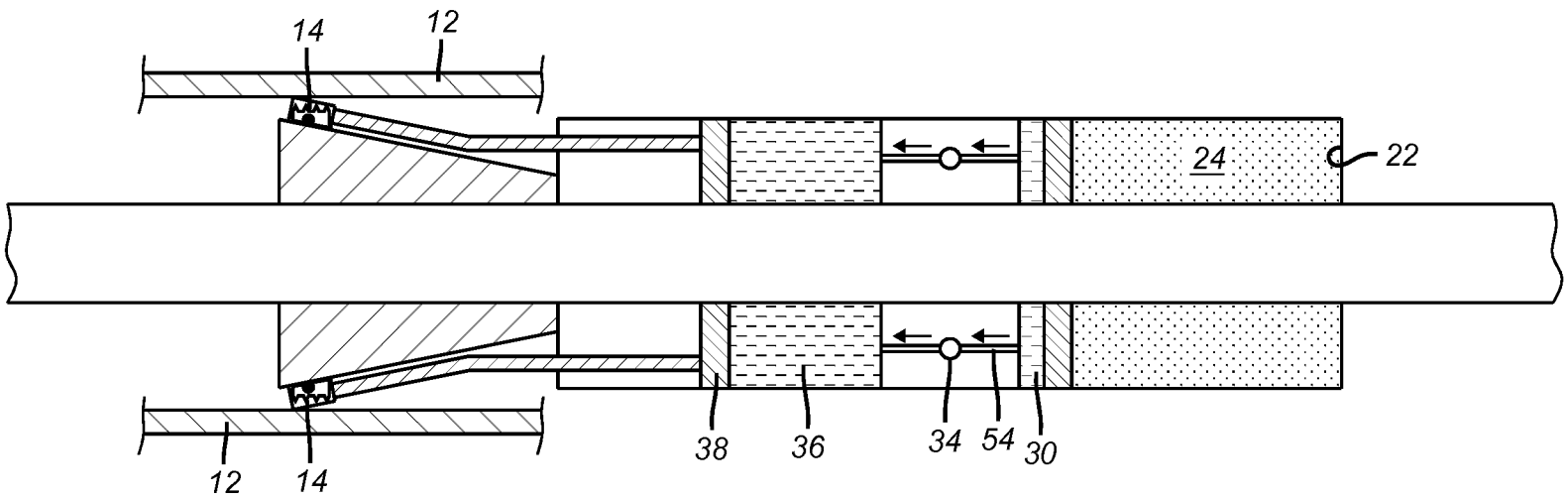
FIG. 2 is the assembly of FIG. 1 in the set position downhole after the trigger is actuated.

FIG. 2 shows the tool 14 set against the casing or wellbore or tubular 12 after the cement (not shown) has been circulated and placed downhole but before it has cured. The opening of valve 34 has allowed the fluid 24 to expand the chamber 22 and displace the oil 30 from chamber 28 and into chamber 36. As a result piston 38 is displaced setting the tool 14. While the pistons 26 and 38 are shown as annular pistons they can also be rod pistons. Piston 26 can be eliminated so that the opening of valve 34 can employ the compressible fluid directly to move the piston 38 that is connected to the link or links 16. The movement of the piston 38 is preferably axial but it can be rotational or a combination of the two when properly guided in its movements for setting the tool 14. Although it is preferred to set the tool 14 as quickly as possible the rate at which it sets can be controlled with the size of the passage 54 that leads to and away from valve 34. While using light oil 30 is preferred other relatively low viscosity fluids down to water can be used. The use of the piston 26 allows compensation for thermally induced pressure buildup in the compressible fluid 24 triggered by the temperature of the surrounding well fluids. Apart from the various signals mentioned above for opening the valve 34, other triggers are possible although their use is less optimal than the techniques already discussed. The valve 34 can be triggered with time, temperature or proximity to devices carried by the string 10 that communicate in a variety of forms with the sensors and processor in the housing 32. While the preferred tool 14 is an annular barrier other tools can be actuated outside the tubular 10 while avoiding having openings through its walls. Some of those tools can be anchors or centralizers, for example. While compressed gas as the potential energy source is preferred other options such as using a shape memory alloy or a bistable material or a mechanical spring such as a coiled spring or a Belleville washer stack to trigger piston 38 are other options.

The above description is illustrative of the preferred embodiment and many modifications may be made by those skilled in the art without departing from the invention whose scope is to be determined from the literal and equivalent scope of the claims below.

We claim:

1. A setting tool mounted externally to a subterranean tubular string for selectively setting an associated tool for selective contact to a surrounding tubular around the subterranean tubular, comprising:

a tubular mandrel defined by a wall having no wall openings and having opposed ends adapted to be connected to the subterranean tubular string to become a pressure containing integral part of the string;

a housing mounted externally on said tubular mandrel and containing an isolated pressurized fluid potential energy force and said potential energy force remotely selectively releasable with a stationary valve for mechanical operation of the setting tool without mandrel manipulation or fluid flow between said mandrel and said housing;

said pressurized fluid remaining in a variable volume chamber that enclosed said pressurized fluid during running in and setting said setting tool.

2. The tool of claim 1, wherein:

said potential energy force comprised of a compressible fluid.

3. The tool of claim 1, wherein:

said housing comprising at least one piston defining a chamber for said potential energy.

4. The tool of claim 1, wherein:

said potential energy is released by actuation of said valve in said housing.

5. The tool of claim 4, wherein:

said valve is operated by acoustic signal, a vibration signal, a change in magnetic field, or elastic deformation of said tubular wall adjacent the valve.

6. The tool of claim 5, wherein:

said valve located on the opposite side of said piston from said potential energy source.

7. The tool of claim 6, wherein:

said piston is a floating piston.

8. The tool of claim 1, wherein:

said potential energy source comprises of at least one or more of a group consisting of a mechanical spring, a chemical reaction, a stack of Belleville washers, a shape memory material, a compressed fluid and a bistable material.

9. The tool of claim 8, wherein:

said valve is actuated with at least one or more of a group consisting of a vibratory or acoustic signal, application of an energy field in the vicinity of said valve and elastic deformation of a wall of a tubular that runs through said housing.

10. The tool of claim 9, wherein:

said valve is selectively actuated to open.

11. The tool of claim 9, wherein:

said field is applied with a dart passing through the tubular adjacent said valve.

12. The tool of claim 9, wherein:

said field is applied employing a wireline tool lowered into said housing.

13. A setting tool mounted externally to a subterranean tubular string for selectively setting an associated tool for selective contact to a surrounding tubular string, comprising:

a housing containing a pressurized fluid potential energy force as part of the subterranean tubular string and selectively releasable for operation of the tool to engage the surrounding tubular without housing manipulation, fluid flow or pressure communication to said housing from within or outside the tubular;

said potential energy is released by actuation of a valve in said housing;

said valve is remotely operated;

said housing comprises at least one piston with said valve located on the opposite side of said piston from said potential energy source;

said pressurized fluid remaining in a variable volume cavity on one side of said piston for running in as and before said valve is remotely operated to allow said piston to move;

said piston is a floating piston;

said valve is located in a chamber between said floating piston and a second piston, wherein movement of said second piston actuates the tool.

14. The tool of claim 13, wherein:

said second piston is connected to the associated tool with at least one link.

15. The tool of claim 14, wherein:

said link displaces the tool on a ramp mounted on the tubular.

16. The tool of claim 15, wherein:

the tool comprises a seal;

movement of said link extends said seal on said ramp for sealing an annular gap around said housing.

17. The tool of claim 16, wherein:

said seal is metallic.

18. A setting tool mounted externally to a subterranean tubular for selectively setting an associated tool, comprising:

a housing containing a potential energy force when run into the subterranean location and selectively releasable for operation of the tool without mandrel manipulation, fluid flow or pressure communication to said housing from within or outside the tubular;

said potential energy is released by actuation of a valve in said housing;

said valve is remotely operated;

said housing comprises at least one piston with said valve located on the opposite side of said piston from said potential energy source;

said piston is a floating piston;

said valve is located in a chamber between said floating piston and a second piston, wherein movement of said second piston actuates the tool;

said chamber immediately adjacent to where said valve is located contains an incompressible fluid.

19. The tool of claim 18, wherein:

said fluid comprises oil or any liquid compatible with operation of valve.

20. A setting tool mounted externally a subterranean tubular for selectively setting an associated tool, comprising:

a housing containing a potential energy force when run into the subterranean location and selectively releasable for operation of the tool without mandrel manipulation, fluid flow or pressure communication to said housing from within the tubular;

said housing comprising at least one piston defining a chamber for said potential energy;

said housing is vented through a check valve located on the opposite side of said piston from said potential energy source.

21. A method of setting a subterranean tool with a setting tool, comprising:

mounting the subterranean tool and setting tool externally to a tubular mandrel without wall openings on the mandrel, said setting tool moving the subterranean tool into contact with a surrounding tubular string;

providing a self contained potential energy source in the setting tool;

connecting end connections on said mandrel to a tubular string positioned within said surrounding string to make said mandrel a pressure bearing component of said tubular string;

delivering said mandrel to a desired subterranean location;

mechanically operating said setting tool with a signal from a remote location upon release of said potential energy source while holding said mandrel stationary.

22. The method of claim 21, comprising:

using a signal other than mandrel manipulation, fluid pressure or fluid flow within said mandrel for said operating.

23. The method of claim 22, comprising:

actuating said setting tool with release of a potential energy force.

24. The method of claim 23, comprising:

using as said potential energy source at least one or more of a group consisting of a mechanical spring, a stack of Belleville washers, a shape memory material, a compressed fluid, and a bistable material.

25. The method of claim 22, comprising:

retaining a potential energy source in said setting tool with a selectively opened valve.

26. The method of claim 25, comprising:

opening said valve without intervention in said mandrel.

27. The method of claim 25, comprising:

moving at least one piston by opening said valve.

28. The method of claim 27, comprising:

providing as said at least one piston an actuating piston whose movement actuates the subterranean tool.

29. The method of claim 25, comprising:

retaining said potential energy force on an opposed side of a floating piston from said valve.

30. The method of claim 29, comprising:

providing a variable volume chamber between said floating piston and said valve that holds a compressible fluid.

31. The method of claim 25, comprising:

using as said signal at least one or more of a group consisting of a vibratory or acoustic signal, application of an energy field in the vicinity of said valve and elastic deformation of a wall of said tubular mandrel.

32. A method of setting a subterranean tool with a setting tool, comprising:

mounting the subterranean tool and setting tool externally to a tubular mandrel without wall openings on the mandrel, said setting tool moving the subterranean tool into contact with a surrounding tubular;

delivering said mandrel to a desired subterranean location;

operating said setting tool with a signal;

using a signal other than mandrel manipulation, fluid pressure or fluid flow within said mandrel for said operating;

retaining a potential energy source in said setting tool with a selectively opened valve;

retaining said potential energy force on an opposed side of a floating piston from said valve;

providing a fluid containing variable volume actuation chamber defined by an actuation piston and said valve;

moving said actuating piston to set the subterranean tool.

33. A method of setting a subterranean tool with a setting tool, comprising:

mounting the subterranean tool and setting tool externally to a tubular mandrel without wall openings on the mandrel;

delivering said mandrel to a desired subterranean location;

operating said setting tool with a signal;

using a signal other than mandrel manipulation, fluid pressure or fluid flow within said mandrel for said operating;

retaining a potential energy source in said setting tool with a selectively opened valve;

retaining said potential energy force on an opposed side of a floating piston from said valve;

providing a fluid containing variable volume actuation chamber defined by an actuation piston and said valve;

moving said actuating piston to set the subterranean tool;

connecting said actuation piston with a link to connect to the subterranean tool through a sealed chamber.

34. A method of setting a subterranean tool with a setting tool, comprising:

mounting the subterranean tool and setting tool externally to a tubular mandrel without wall openings on the mandrel;

delivering said mandrel to a desired subterranean location;

operating said setting tool with a signal;

using a signal other than mandrel manipulation, fluid pressure or fluid flow within said mandrel for said operating;

retaining a potential energy source in said setting tool with a selectively opened valve;

retaining said potential energy force on an opposed side of a floating piston from said valve;

providing a fluid containing variable volume actuation chamber defined by an actuation piston and said valve;

moving said actuating piston to set the subterranean tool;

venting said sealed chamber as said actuation piston moves through a check valve.

* * * * *